US010226394B2

(12) United States Patent
Aldridge et al.

(10) Patent No.: US 10,226,394 B2
(45) Date of Patent: Mar. 12, 2019

(54) RANGE OF MOTION FLEXIBILITY DEVICE AND METHOD OF USE

(71) Applicant: BAM Motion, Inc., Novato, CA (US)

(72) Inventors: Robert Aldridge, Novato, CA (US); Shari Aldridge, Novato, CA (US)

(73) Assignee: BAMmotion, Inc., Novato, CA (US)

( * ) Notice: Subject to any disclaimer, the term of this patent is extended or adjusted under 35 U.S.C. 154(b) by 0 days.

(21) Appl. No.: 15/948,880

(22) Filed: Apr. 9, 2018

(65) Prior Publication Data

US 2018/0221234 A1 Aug. 9, 2018

Related U.S. Application Data

(63) Continuation of application No. 14/451,343, filed on Aug. 4, 2014, now Pat. No. 9,937,096, which is a (Continued)

(51) Int. Cl.

| | |
|---|---|
| ***A61H 1/02*** | (2006.01) |
| ***A63B 23/00*** | (2006.01) |
| ***A63B 23/04*** | (2006.01) |

(52) U.S. Cl.

CPC ..... *A61H 1/0237* (2013.01); *A61H 1/0274* (2013.01); *A61H 1/0292* (2013.01); *A61H 2201/1253* (2013.01); *A61H 2201/1284* (2013.01); *A61H 2201/164* (2013.01); *A61H 2201/1621* (2013.01); *A61H 2201/1635* (2013.01); *A61H 2201/1652* (2013.01); *A63B 23/0405* (2013.01); *A63B 2023/006* (2013.01)

(58) Field of Classification Search

CPC .. A61H 1/0237; A61H 1/0292; A61H 1/0274; A61H 2201/1635; A61H 2201/1621; A61H 2201/164; A61H 2201/1284; A61H 2201/1253; A61H 2201/1652; A63B 2023/006; A63B 23/0405

See application file for complete search history.

(56) References Cited

U.S. PATENT DOCUMENTS 324,498 A * 8/1885 Surbaugh ..... A61B 17/42 601/45

579,818 A * 3/1897 Cooley ..... B60R 22/26 297/468

(Continued)

*Primary Examiner* — Garrett K Atkinson

(74) *Attorney, Agent, or Firm* — KW Law, LLP

(57) ABSTRACT

A stretching device comprises a wearable body harness with an adjustable central hold arranged around the upper body connected with an adjustable extension strap configured to engage a foot at a distal end. The extension strap is slidably connected to the central strap to move along the length of the central strap. The extension strap comprises a non-elastic material, divided by a single elastic segment. The extension strap having incremental markings designating amount of adjustment. The device and method of using the device provides a comfortable tension, facilitates hands free stretching in the supine position, improving duration of stretching and range of motion. An independent adjustable stretching strap for upper body and shoulder stretching, further comprises a non-elastic material looped at each distal end, divided by a discrete elastic segment and having incremental visual markings designating amount of adjustment.

10 Claims, 9 Drawing Sheets

Related U.S. Application Data continuation-in-part of application No. 13/528,779, filed on Jun. 20, 2012, now Pat. No. 9,114,270.

(56) References Cited

U.S. PATENT DOCUMENTS 1,551,932 A * 9/1925 Carver ..... A47D 15/006 297/466
1,608,032 A * 11/1926 McNabb ..... A61F 5/0104 602/30
2,212,746 A * 8/1940 Nunn ..... A47D 13/086 119/770
3,519,269 A * 7/1970 Howlett ..... A63B 21/018 473/438
3,659,846 A * 5/1972 Kanicki ..... A63B 21/023 2/24
3,999,752 A * 12/1976 Kupperman ..... A63B 21/154 273/DIG. 19
4,010,744 A * 3/1977 Boyen ..... A61F 5/3715 602/32
4,220,328 A * 9/1980 Crush, Jr. ..... A63B 21/28 482/92
4,273,327 A * 6/1981 Nall ..... A63B 21/0004 482/146
4,371,162 A * 2/1983 Hartzell ..... A63B 21/04 482/123
4,456,249 A * 6/1984 Calabrese ..... A63B 21/154 482/124
4,588,186 A * 5/1986 Calabrese ..... A63B 21/154 482/131
4,667,624 A * 5/1987 Smith ..... A01K 27/00 119/770
5,069,449 A * 12/1991 Wardwell ..... A63B 21/151 482/126
5,258,017 A * 11/1993 Myers ..... A61H 1/0218 482/131
5,348,035 A * 9/1994 Porter ..... A61H 3/02 135/66
D358,625 S * 5/1995 Enriquez, Jr. ..... D21/686
5,518,486 A * 5/1996 Sheeler ..... A63B 21/0004 482/131
5,595,559 A * 1/1997 Viel ..... A61H 1/0237 482/114
5,624,360 A * 4/1997 Wilkins ..... A63B 21/1645 482/121
5,704,856 A * 1/1998 Morse ..... A63B 21/0004 473/212
5,769,764 A * 6/1998 Tilberis ..... A63B 23/03575 482/124
5,803,881 A * 9/1998 Miller ..... A63B 21/0004 482/124
5,860,944 A * 1/1999 Hoffman, Jr. ..... A61F 5/026 2/44
5,951,443 A * 9/1999 Askins ..... A63B 23/047 482/124
6,299,569 B1 * 10/2001 Rich ..... A63B 21/0004 482/121
D493,001 S * 7/2004 Urban ..... D24/190
6,840,894 B2 * 1/2005 Lerner ..... A63B 21/0552 482/121
6,921,354 B1 * 7/2005 Shifferaw ..... A63B 21/068 482/126
7,223,212 B2 * 5/2007 DiOrio ..... A63B 21/0023 482/83
7,384,382 B2 * 6/2008 Farrah ..... A63B 21/153 273/453
7,438,653 B2 * 10/2008 Anderson ..... A63B 69/0002 473/422
7,467,604 B1 * 12/2008 Werner ..... A01K 27/00 119/770
7,608,026 B1 * 10/2009 Nicassio ..... A63B 21/00185 24/265 BC
7,749,141 B2 * 7/2010 Meisterling ..... A63B 21/0004 482/121
7,842,000 B2 * 11/2010 Lai ..... A61F 5/026 602/19
7,874,970 B2 * 1/2011 Glisan ..... A63B 21/0552 482/124
7,955,236 B2 * 6/2011 DiGiovanni ..... A63B 21/0552 482/124
8,282,536 B2 * 10/2012 Latronica ..... A63B 21/16 482/121
D694,414 S * 11/2013 Sparkes ..... D24/190
8,696,527 B2 * 4/2014 Wu ..... A63B 21/068 482/131
8,715,145 B1 * 5/2014 Winbush ..... A63B 69/0028 482/124
8,979,716 B1 * 3/2015 Rawlins ..... A63B 21/0442 482/129
2005/0085350 A1 * 4/2005 Shen ..... A63B 23/00 482/91
2005/0261113 A1 * 11/2005 Wilkinson ..... A63B 21/0004 482/124
2006/0124162 A1 * 6/2006 Sweeney ..... A61F 5/0102 135/65
2007/0173382 A1 * 7/2007 Axelrod ..... A63B 21/0004 482/91
2009/0011909 A1 * 1/2009 Glisan ..... A63B 21/0552 482/129
2009/0062087 A1 * 3/2009 Poppinga ..... A63B 21/0552 482/124
2015/0057135 A1 * 2/2015 Cranke ..... A63B 21/0557 482/124
2016/0107309 A1 * 4/2016 Walsh ..... B25J 9/0006 248/550

* cited by examiner 89A
87
63
89B
82
83
81
80
84
86
85
70

89B
82
83
88
84
81
86
72
85
70

91
97
95
96
94
93
92
90

91
97
95
71
96
94
98
93
92

22
21
20
19
18
17
16
15
14
13
12
11
10
9
8
7
6
5
4
3
2
1
44
43
42
41
40
39
38
37
36
35
34
33
32
31
30
29
28
27
26
25
24
23

RANGE OF MOTION FLEXIBILITY DEVICE AND METHOD OF USE

CROSS REFERENCE TO RELATED APPLICATIONS

The present application is a continuation of U.S. patent application Ser. No. 14/451,343, filed on Aug. 4, 2014, entitled Range of Motion Flexibility Device and Method of Use, issued as U.S. Pat. No. 9,937,096, which is a continuation in part of U.S. patent application Ser. No. 13/528,779, filed on Jun. 20, 2012, entitled Range of Motion Flexibility Device and Method of Use, issued as U.S. Pat. No. 9,114,270, the entire contents of which are herein incorporated by reference for any purpose.

FIELD

This invention relates to a device and method to aid in stretching the body. More particularly, the invention relates to a wearable and hands-free stretching device for improving body flexibility and range of motion.

BACKGROUND

Stretching is an integral part of proper exercise or fitness routine. It is further an essential component of physical therapy and sports medicine. Stretching reduces tissue injury, improves flexibility, helping joints move through their full range of motion and increases blood flow to muscles. Those who regularly work out including athletes understand the benefits of stretching and improving body flexibility as well as range of motion during exercise programs and to perform certain elements during competitive routines. For anyone engaging in physical activity, stretching has long been recommended in warm up and cool down regimens. Various methods are used for stretching. Some methods involve stretching without any device by using one's own body or applying tension on an external stationary object, while some methods involve use of an apparatus. Stretching should be performed slowly and steadily, in a controlled manner, to reduce injuries such as muscle or ligament tearing. Stretching should also be performed for required duration to prevent tissue injury and improve flexibility.

Some existing methods and devices for stretching do not maximize the benefits of appropriate stretching and can actually cause side effects due to improper form and misalignment of the body. Some stretching devices for targeted leg and back stretching require the use of arms to hold onto a device, thereby putting unnecessary strain on the person especially discomfort in the upper body. Such devices as yoga straps further are not connected to or supported by the body and thereby lead to often cumbersome, awkward, uncomfortable or inefficient hand guiding. Some devices require the use of an external stationary object to connect the device to create the necessary tension, thereby making the convenience of using such a device a problem. Such use of external objects or the user's hands to create tension results in difficulty in use, shorter duration of the stretching, limited range of motion and may compromise safety.

Accordingly, the need for a stretching device and method that can minimize side effects of such inappropriate and inconvenient stretching is apparent. At the same time, there is a need to maximize benefits of efficient stretching by improving duration and range of motion through comfortable, hands free stretching, while maintaining safety and productivity.

There is also the need for a self-contained stretching device and method that indicates progress of stretching to a user, by providing a visual quantitative indication on the device as to the increase in user's range of motion and intensity in stretch.

SUMMARY

Some embodiments of the present invention satisfy these needs. Some embodiments of the present invention include a novel hands-free stretching device that is wearable and self-contained. In an embodiment, the device comprises a body harness with arm or shoulder holds.

One object of the present invention is to provide comfortable tension. Another object of some embodiments of the present invention is hands free stretching which the user is in the supine position, allowing for a relaxed upper body and comfortable movement of an extension leg strap including the side-to-side direction without interfering with the position of the harness.

Still another object of some embodiments of the present invention is to allow upper body stretching since hands are not required to hold any part of the device.

A related object is to allow a user to stretch for longer duration of time by providing maximum comfort during the stretching process. As an aspect of the invention allows the user to stretch hands free in the supine position, the device further encourages people of all ages to productively stretch for a relaxing and longer pace.

Another related object is to allow a user to stretch arms, shoulders and the upper body for a longer duration of time by providing maximum comfort during the stretching process.

In another object, in stretching the different parts of the body there is provided the ability for clear indication of stretching improvement on the device.

The above objects are accomplished, for example, by providing a device comprising a body harness including one or more straps made of flexible, non-elastic material to create comfortable tension.

The above objects are accomplished, for example, by providing a shoulder harness that fits snugly over upper torso for hands free stretching. The body harness includes at least one shoulder support hold and an adjustable central torso hold for arranging around an upper torso of the body; and at least one adjustable extension strap having a first end and a second end, the first end slidably attached to the body harness to move continuously along the transverse length of the body harness, and the second end forming an appendage support, such as a loop. In another embodiment, the extension strap further comprises a strap adjuster, wherein the first end secured to the front of the harness and the second end positioned through the strap adjuster to form an adjustable distal loop.

The objects are further accomplished, for example, by providing a slidable guide segment attached to the extension strap at one end and from the other end to the harness along a length of the central hold. The movable guide segment allows the extension strap(s) to move/glide freely around the upper torso to allow full range of motion, side to side stretching.

One embodiment of the present invention is use of flexible but non-elastic material to create comfortable tension. According to embodiments of the present invention, the strap components are comprised of woven fabric such as cotton or synthetic material webbing including sublimated nylon webbing.

One embodiment of the present invention is use of an O ring for the movable segment. Another embodiment of the present invention comprises the device using hooks similar to a carabiner or mountaineering hooks. Another embodiment of the present invention is use of a clip. Another embodiment of the present invention is use of a loop slidable around the central strap sewn from the connecting end of the adjustable strap around the central strap.

Another embodiment of the present invention is use of additional smaller movable straps connected to the central strap as hand straps similar to leg straps but of shorter length for stretching the upper body. In one aspect, the device components may be disassembled such as the central hold from a shoulder strap or extension strap, with two of the straps locked through one another for upper body, shoulder/arm stretching. In an alternative aspect, one of the straps such as the extension strap itself is disconnected and adjusted to be long enough to conduct the shoulder/arm stretching.

Another embodiment of the present invention is use of detachable connectors to connect additional smaller movable straps to the central strap. The extension strap may include a strap adjuster and or a buckle connection for disconnecting the distal end of the extension strap from the extension strap. Similarly, the harness including the central hold as well as one or more of the shoulder holds may include a strap adjuster and connection assembly for easy removal and adjustability of the straps.

The above objects are accomplished, for example, by providing a strap for shoulder and arm stretching creating comfortable tension with an adjustable loop at one end.

The above objects are accomplished, for example, by providing a strap having looped distal ends, for shoulder and arm stretching provided with an elastomeric segment to create comfortable tension, wherein one of the distal ends is an adjustable loop.

One embodiment of the present invention is use of a segment made of elastomeric material attached to the extension strap to create an improved comfortable tension. In one aspect of this embodiment, the segment can be made of an elastomeric substance such as rubber. In another embodiment, the elastomeric section is a plurality of discrete (separate and distinct) elastic components.

In another embodiment the rubber segment can be in the form of extruded rubber trapped forming a handle around a slidable component such as an O ring, hook, clip or loop. In yet another embodiment, the rubber segment can be in the form of a band trapped in the slidable attachment part such as an O ring, hook, clip or loop.

Another embodiment of the present invention is use of a rubber segment attached to the extension strap where one of the straps such as the extension strap itself is disconnected and adjusted to be long enough to conduct the shoulder/arm stretching. In one embodiment, the rubber segment can be in the form of extruded rubber trapped in grommets. In another embodiment, this rubber segment can be an in-molded rubber block. The extension strap, one end that attaches to the central harness and the other that is used as a foothold, may be handheld and used to stretch the arms and shoulders with comfortable tension.

In yet another related embodiment, there is a standalone upper body stretching strap comprising a flexible and non-elastic material, having looped distal ends that are connected by an elastomeric segment. One of the looped ends is made adjustable by a strap adjuster. The configuration of the looped ends provides the necessary grip and support for arm and shoulder stretching. The elastomeric segment in the strap provides a slight give to allow the user to increase flexibility while the non-elastic strap maintains tension.

Another embodiment of the invention comprises incremental markings to measure the length of the strap as it is pulled or loosened to accommodate the length of the leg or the arm span or to increase flexibility. In an embodiment, the portion of the strap marked may be indicated at a base thirty inches and then shortened as flexibility improves or depending on height of the user. A user can improve and track flexibility with the measurement markings. As a user's flexibility increases, the increase of strap length pulled through the adjuster will indicate progress. The markings can further be an easy indication at which to set the strap length so that different users may interchangeably use the device and set the length quickly to the desired length.

The incremental markings are a clearly visible indicator that may be located on the body harness along the central strap end that is pulled through the central strap adjuster. The incremental markings are further located on the extension strap along the end of the extension strap that is pulled through the extension strap adjuster. On the arm and shoulder strap, the incremental markings are located on the adjustable strap end that is pulled through the strap adjuster.

These and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Figure 1:
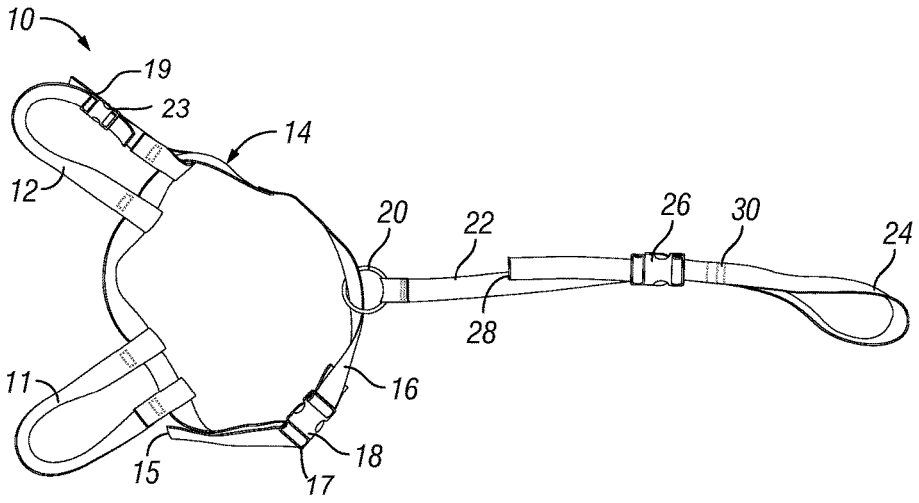
FIG. 1 is a view of the device in assembled form in accordance with an embodiment of the present invention.

An embodiment of the present invention is a range of motion flexibility device as illustrated in FIG. 1. The device 10 comprises a shoulder or body harness 14 with a central hold or strap 13 arranged around the upper torso; a movable segment 20 attached to an adjustable extension strap 22 with a distal end appendage support such as loop 24. The movable segment 20 is attached to the extension strap 22 with a first end secured around the movable segment 20, for example the first end sewn upon itself at a point 21. The central hold 13 is provided with a connector assembly 18 for easy removal. The body harness 14 comprises at least one shoulder hold and in an embodiment, two shoulder holds 11, 12 to keep the device balanced and comfortably snug in place during the stretching motion.

According to an embodiment, as shown in FIG. 1, the adjustable extension strap 22 comprises a distal loop 24 which may be formed by securing an end of the extension strap onto itself. In an embodiment, the loop 24 is sewn upon itself at point 30. The loop 24 serves as an appendage support, foothold, during the stretching motion. The extension strap 22 further comprises a connector assembly 26 which may further serve as a strap adjuster.

The device 10 can be made of various materials. Flexible, non-elastic materials forming a strong, yet lightweight woven material is a desired for the strap components. Such woven material may include a woven fabric, including cotton or flax, as well as synthetic materials including vinyl or polymer materials. The straps may be manufactured as a cotton or canvas webbing, as well as synthetic webbing including nylon, polypropylene, polyester and blends thereof.

In one preferred embodiment, the device strap components are made of flexible and strong canvas strap such as a typical yoga strap. In another preferred embodiment the strap is made of lightweight polypropylene.

Figure 2:
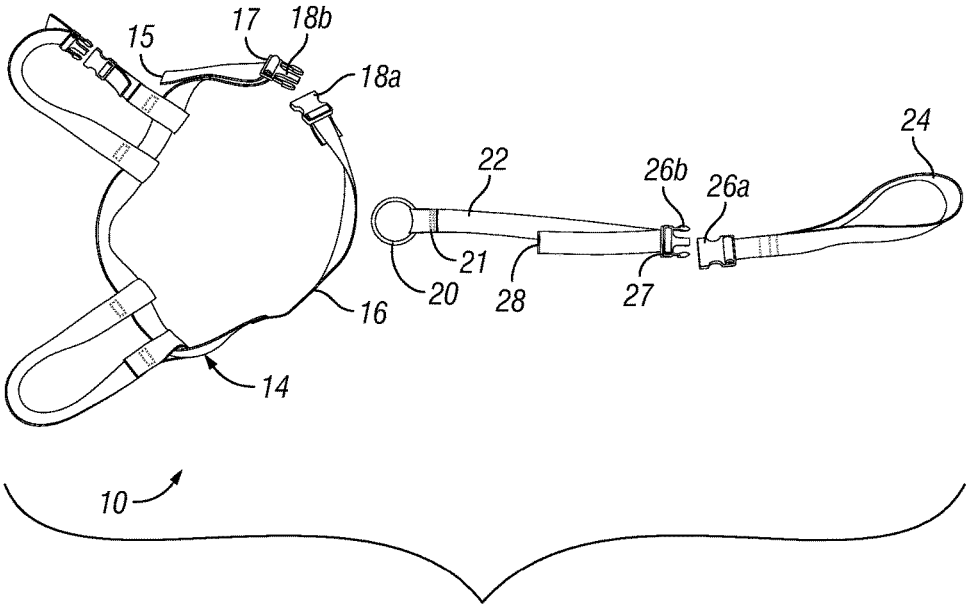
FIG. 2 shows a view of the device in a disassembled form according to an embodiment of the present invention.

As shown in FIG. 2 the device 10 is shown in a disassembled or disconnected position in which the harness connection assembly 18 is in the open position. In an embodiment, connector assembly 18 is made of a snap buckle for easy removal showing a receiving end 18*a* and an insertion end 18*b*. In an embodiment, the connector assembly 18 is connected to a first end of the central strap 13 at the receiving end 18*a* and to a second end 15 at the insertion end 18*b* in which the second end 15 is pulled through the strap adjuster 17 on the insertion end 18*b* of the buckle 18. The first end may further be secured upon itself at the receiving end 18*a* or also engaged through a respective strap adjuster.

Due to the ability to conveniently and quickly disassemble the harness structure, the central hold 13 of the harness 14 may be rearranged to position the connector assembly on a different side or location of the body. For example, FIG. 2 shows the central hold 13 of the harness 14 arranged in opposite fashion from that in FIG. 1, such that the connector assembly 18 is on a different side.

As further illustrated in FIG. 2, the extension strap 22 may be disconnected from the end loop 24 at the connector assembly 26. The end loop 24 is securely attached a receiving end 26*a* of the connector assembly 26. The extension strap length is made adjustable through the strap adjuster 27 at one side of the connector assembly 26, such as at the insertion end 26*b*, by threading an extension strap end 28 through the adjuster 27. The strap adjuster 27 may further be a separate component from the connector assembly 26.

In an embodiment, the connector assemblies 18, 26 comprise a buckle connection. The connector assemblies may be selected from a group consisting of, but not limited to, clasps, fasteners and buckles including side release buckles, center release buckles, cam and spring buckles or ratchet buckles. The material used for the connector assemblies 18, 26 including connected or separate strap adjusters, may be selected from plastic hardware or metal hardware.

According to an embodiment, the movable segment 20 is made of an O ring for easy gliding on the central strap 13 to allow side to side movement of legs and arms to allow range of motion stretching. The movable segment 20, in a preferred embodiment, is attached to the central hold 13 or harness component with a quick release mechanism. The movable segment 20 may comprise in other embodiments, of a slidable means including rings, D rings, loops, hooks such mountaineering hooks, snap hooks, carabiners, spring links, or clips, for easy gliding on the central strap to allow side to side movement of legs allow a full range of motion stretching.

In another embodiment, the movable segment 20 is made of a loop formed by the end of the extension strap 22 secured upon itself, to connect with the central strap 13 for easy gliding on the central strap to allow side to side movement of legs and arms to allow range of motion stretching.

According to an embodiment, the central hold 13 is integrated with a low friction front portion 16 along which the movable segment 20 easily glides along the transverse plane of the body. The low friction portion 16 may comprise the same or different material as used throughout the harness. In an embodiment, the central hold 13 includes an overlapping outward facing guide cable resting along the central hold 13. The extension strap 22 may be directly engaged upon the guide cable for slidably moving along the guide cable in front of the central strap 13 such that the guide cable does not interfere with the harness 14 during movement. Importantly, the extension strap 22 is engaged with the front of the harness 14, for example with the low friction portion 16 of the central hold 13, for a continuous sliding motion, allowing for hands free, secure and aligned back stretching. The harness 14 including the central hold 13 is adjustable to fit various chest sizes of users.

In a related embodiment, the central hold 13 is placed as a portion in front of an inner strap or wearable section such that the central hold 13 overlaps the inner strap. Both the inner strap and the central hold 13 are made conveniently adjustable to accommodate different chest dimensions/diameters of users of various sizes.

According to an embodiment, the adjustable extension strap 22 is formed of one continuous loop connected by a strap adjuster. In this embodiment, the top of the loop is attached to the central hold 13/front portion 16 while the bottom of the loop serves as the appendage support 24 is where the foot is positioned. In this embodiment, the appendage support 24 is not detachable from the extension strap 22. In an embodiment, the appendage support 24 is configured with a thicker or wider portion at a point where the foot is in contact with the support so as to better grip the bottom of the foot or to improve ergonomic feel.

In some embodiments, some of all of the harness 14 may comprise of a sturdy yet lightweight padded material for added comfort. The harness may be constructed to have only a single shoulder hold or crossover hold providing resting over at least one shoulder to provide necessary resistance on the central hold 13 from pulling downward toward the waist. In another embodiment, a crisscross over the shoulder configuration may be implemented for the harness, either crossing in the front or the back of the body. In another embodiment, the harness may include a flexible, wearable vest such that the straps lay over or are incorporated into the vest material.

In yet another embodiment, each of the shoulder holds 11, 12 of the harness 14 may both or either comprise a length adjuster. The length adjuster 19 providing for the shoulder holds to fit around different sized users and to facilitate easier removal of the device. In a further embodiment, the shoulder holds may be configured for a connection with the central hold 13 such that the shoulder hold is formed of two free ends connected by a connection assembly 23, such as a quick release buckle connection with a strap adjuster 19, positioned to lay on top of the shoulder of in front of the chest in the connected position. This configuration allows for each removal and access in and out of the harness 14, as well as adjustability for different sizes of user bodies. In a further embodiment, either or both Shoulder holds 11, 12 may be configured to form a continuous strap looped to wrap around the central hold 13 strap, with the free ends of the shoulder hold strap connectable by a connection assembly, such as a quick release buckle connection. In such a construct, the ends of the shoulder hold are freely adjustably by a strap adjuster at the connection ends, similar to the adjustable connection 17 on the central hold 13. The connection assembly may lay comfortably on the top of the shoulders or at a position in front of the body for easy access. In this configuration, the shoulder hold may be released and easily removed from the central hold 13.

In embodiments of the present invention, the material used for the harness comprise of lightweight, flexible yet durable material which can sustain the rigors and tension applied by large and strong athletes for continuous and extended periods of time. The harness and the strap components may comprise of comfortable, breathable or moisture wicking materials or fabrics commonly used in sportswear, activewear or performance wear. Components in direct contact with the body may comprise of hi-tech fabrics with the aim of moisture control and keeping the body cool by moving perspiration away from the skin. Other components, connectors, hardware, as well as the straps of the device may comprise of lightweight yet sturdy elements to withstand large forces applied by a user, as routinely used in fitness and sporting equipment.

Figure 3:
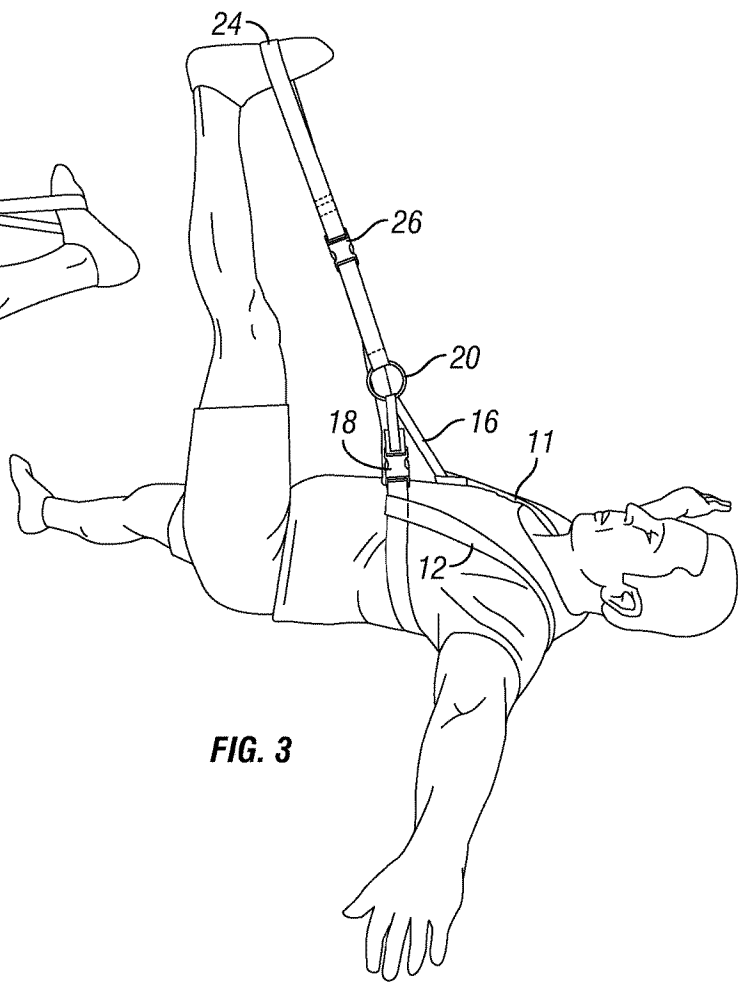
FIG. 3 illustrates the device in use as worn by a person for stretching, according to an embodiment of the present invention.
Figure 4:
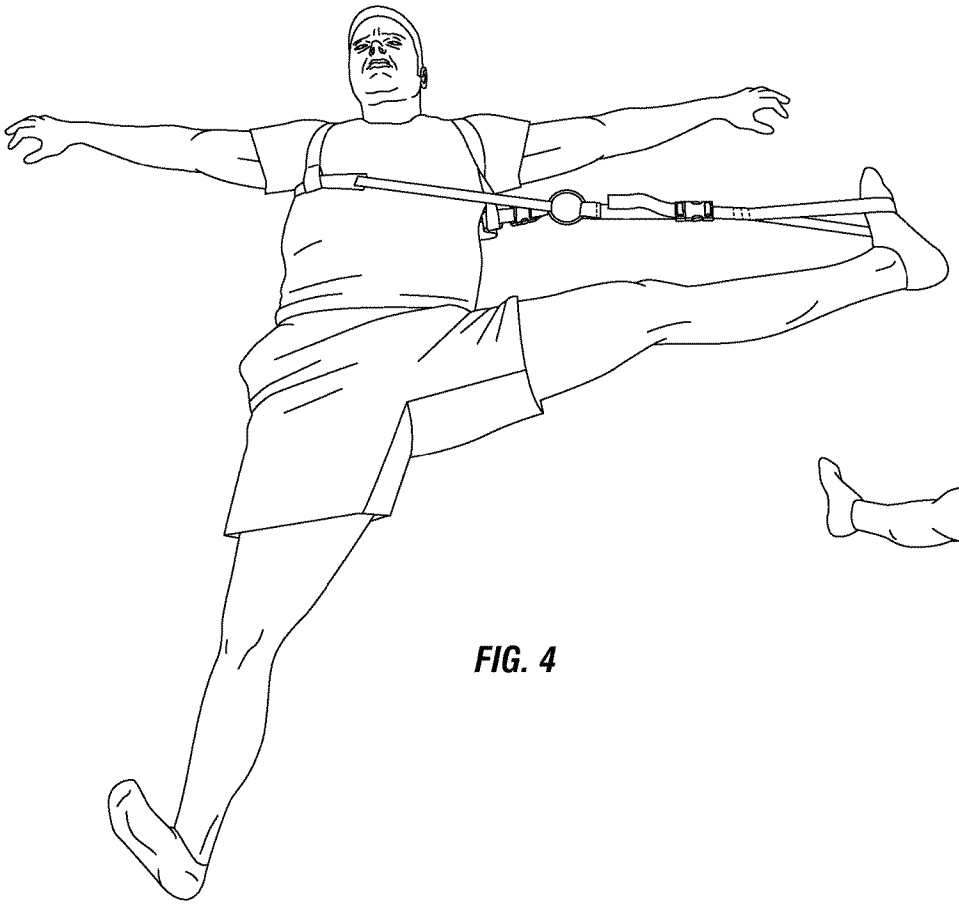
FIG. 4 illustrates the device in use as worn by a person in another stretching position, according to an embodiment of the present invention.
Figure 5:
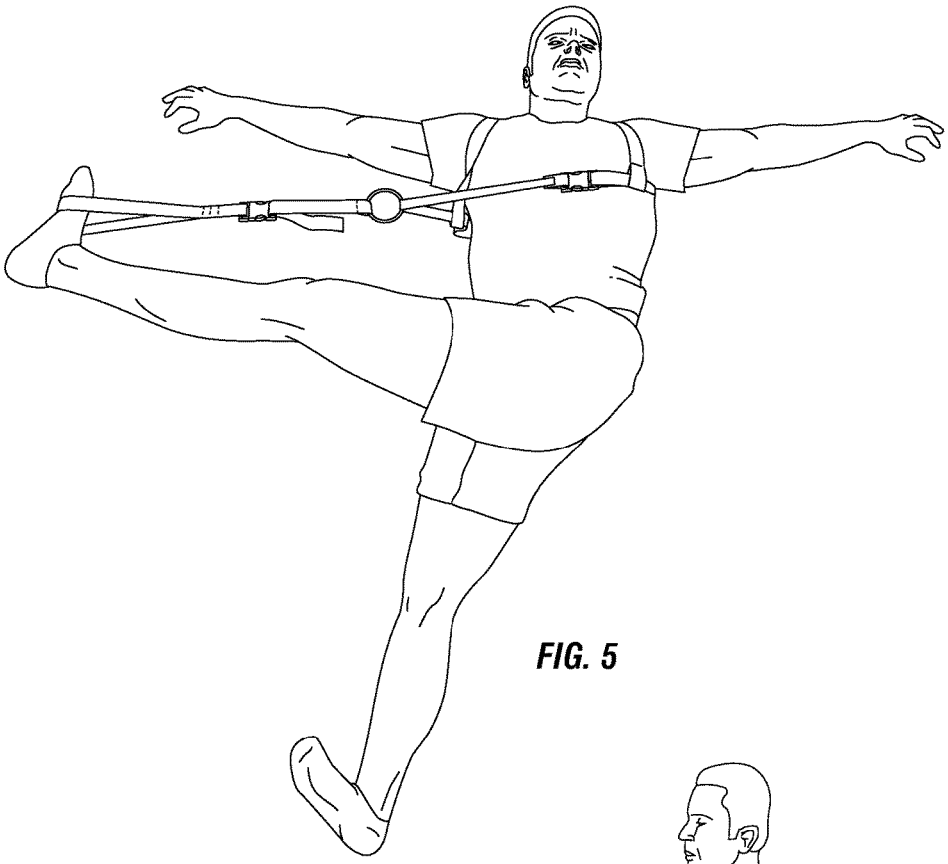
FIG. 5 illustrates the device in use as worn by a person in another stretching position, according to an embodiment of the present invention.

FIGS. 3 to 5 illustrate the use of the device 10 for hands free stretching in a variety of positions. According to an embodiment, the method of using the device comprises arranging the harness over at least one shoulder and the central strap around an upper torso of the body, placing a foot into the appendage support 24 formed at the second end of the extension strap. The extension strap length is adjusted to a desired length for stretching and tension by the leg/foot is applied against the support 24 to perform the hands-free stretching. As shown in FIG. 3, the device is conveniently used when in a supine position as the user maintains the extension strap 22 taut while rotating the leg to move the extension strap 22 along the central strap/front portion 13, 16. The user wears the harness through one or more shoulder holds 11, 12, and adjusts the harness around the torso at the buckle connection 18. The extension strap 22 is adjusted at the connection 26 to the desired length and is freely moved along the front of the harness 14 at the low friction portion 16 via the movable segment 20.

In an embodiment, the extension strap 22 comprises incremental markings to measure the length of the strap as it is pulled or loosened to accommodate the length of the leg or to increase flexibility. For example, the portion which is pulled through the adjuster 27 between the strap end 28 and the adjuster 27 may be marked in half-inch increments to indicate the length of the strap 22. In an embodiment, the portion of the strap marked may be indicated at a base thirty inches and then shortened as flexibility improves or depending on height of the user. A user can improve and track flexibility with the measurement markings. As a user's flexibility increases, the increase of strap length pulled through the adjuster 27 will indicate progress. The markings can further be an easy indication at which to set the strap 22 length so that different users may interchangeably use the device and set the length quickly to the desired length.

FIG. 4 and FIG. 5 show two positions of using the device 10 for stretching the adductor and the abductor of the leg respectively, according to embodiments of the invention. The positions allow for a full stretch of the inner/outer thigh and groin regions. In addition, the hips and back benefit from a proper stretch. As shown, a full range of motion is achieved without the use of hands, while keeping the shoulders flat against the floor and back aligned, resulting in a comfortable stretch, which can be maintained for a longer duration. The continuity of the motion is further made possible by the harness structure and the movable segment along the central strap. The tension of pulling against the device is balanced by the harness and avoids constant adjustment of the strap or use of hands for positioning which are major drawbacks of existing exercise straps.

In using the device in the supine position, the user may further effectively and for longer duration stretch the iliotibial band (IT band) and hip flexors of each side of the body. The IT band extends from the hipbone toward the knee. The IT band attaches to the gluteal muscles as well as the TSL (tensor fasciae latae) which is the muscle on the outside of the hip that moves the leg outward. As shown in the supine position of FIG. 3, the user may additionally extend the right arm to lay flat upward above the head while moving the extended left leg at an angle toward the right shoulder. Similarly, to stretch the IT band on the left side of the body, raise the left arm to lay flat upward above the head while moving the extended right leg at an angle toward the left shoulder. The device thereby provides a conveniently stable and comfortable position to facilitate stretching for extended period of time of various parts of the body.

According to another embodiment, the device components may be disassembled and reassembled with two of the straps locked through one another for upper body, shoulder/arm stretching. For example, interlocking the central hold 13 with any of the shoulder straps 11, 12 or the extension strap 22 or the foothold 24 for example. The foothold 24 therefore can serve as a handhold. In an alternative embodiment, one of the straps, such as the extension strap 22 itself, is disconnected and adjusted to be long enough to conduct the shoulder/arm stretching. The measured markings on the extension strap 22 can thereby be further used to incrementally decrease the length of the strap to increase the intensity of the stretching session or to mark off the size of the user's wingspan for future use. As shown in FIGS. 6-11, a number of upper body, back and shoulder exercises and stretches may be conducted with the device 10 using one of the disconnected straps or with two or more straps as interlocked, thereby further increasing range of motion and flexibility of the body.

Figure 6:
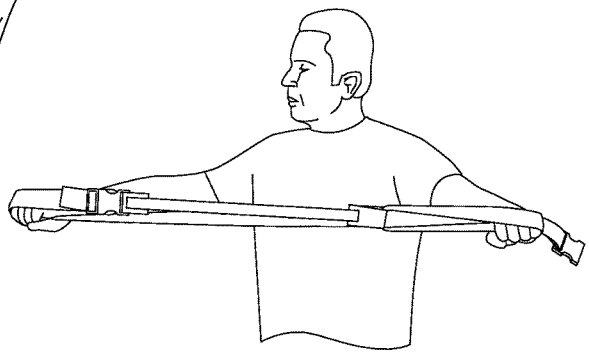
FIG. 6 illustrates the device in use as worn by a person in a shoulder/upper body forward stretching position, according to an embodiment of the present invention.
Figure 7:
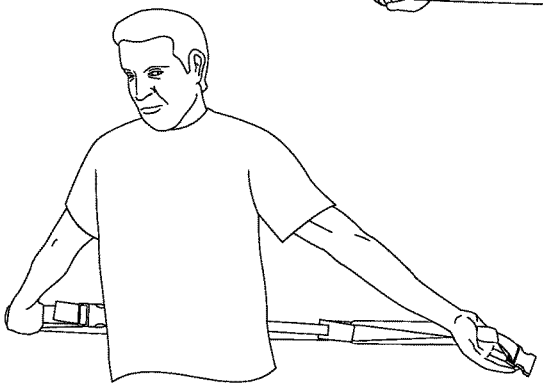
FIG. 7 illustrates the device in use as worn by a person in a backward shoulder/upper body stretching position, according to an embodiment of the present invention.

More particularly, FIG. 6 and FIG. 7 illustrate the device straps interlocked and used in a front and back, over the head motion. The arms are kept straight with elbows locked throughout the range of motion. The motion is repeated from the front over the head to the back and then from the back over the head to touch the front of the body. The device is adjustable to accommodate the arm span of the user.

Figure 8:
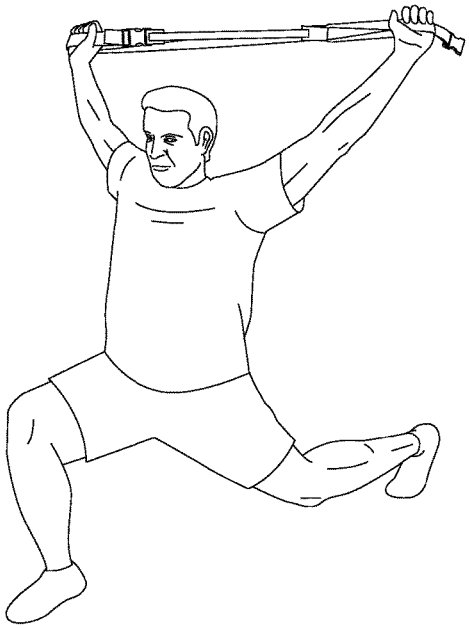
FIG. 8 illustrates the device in use as worn by a person in a shoulder/upper body lunge stretching position, according to an embodiment of the present invention.
Figure 9:
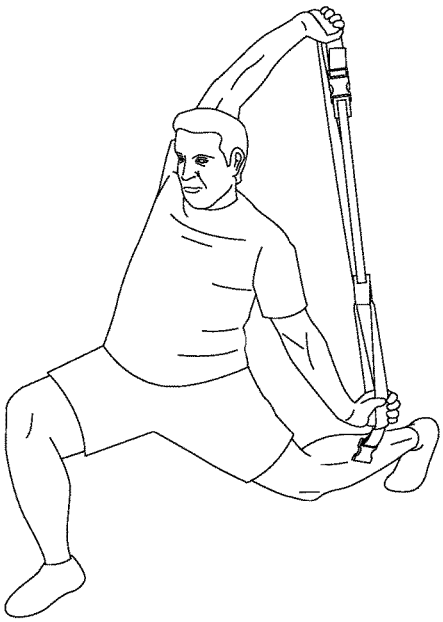
FIG. 9 illustrates the device in use as worn by a person in another shoulder/upper body lunge stretching position, according to an embodiment of the present invention.

As illustrated in FIG. 8 and FIG. 9, the device is illustrated in use in a lunge position. Two particular stretching exercises may be performed using the device. As shown in FIG. 8 the user is in a lunge with the device held taut above the head with elbows locked and stretching is performed in a vertical side-to-side motion over the head. As shown in FIG. 9 the left side stretch is conducted and similarly, the user will continuously move vertically to the right-side stretch. This stretching motion is repeated a number of times and further repeated in the left leg lunge position. The second type of lunge stretch exercise, (not shown), is also conducted while in the lunge position, where the device is used in front of the body in a horizontal side to side stretching with the elbows locked. Similarly, the exercise is repeated in both the right and left leg lunge positions.

Figure 10:
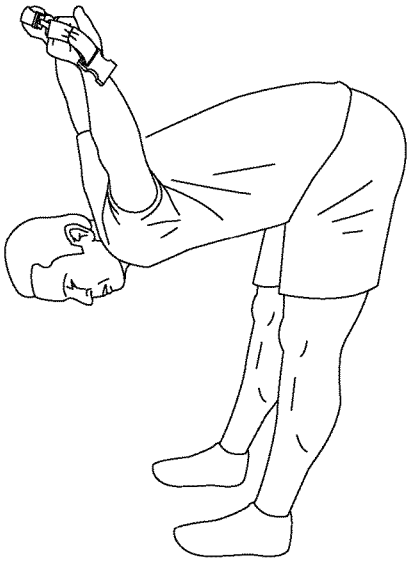
FIG. 10 illustrates the device in use as worn by a person in another shoulder/upper body bent stretching position, according to an embodiment of the present invention.
Figure 11:
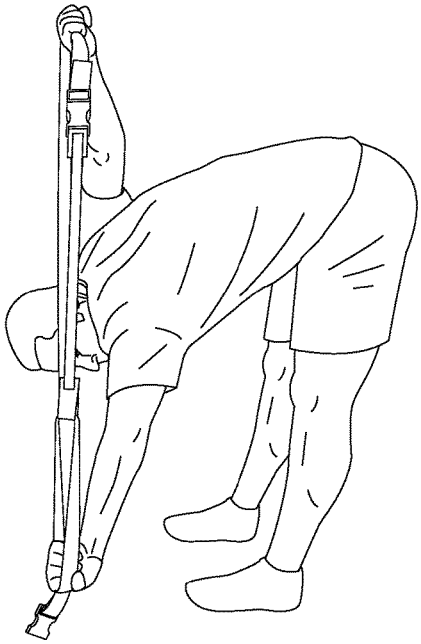
FIG. 11 illustrates the device in use as worn by a person in another shoulder/upper body bent stretching position, according to an embodiment of the present invention.

As further shown in FIGS. 10-11, the device is used in a standing bent over position with the device straps in a taut position. With elbows locked, and knees locked, the user holds the device behind and over the head and rotates in a side-to-side motion. Accordingly, the device is easily disassembled to conduct such shoulder/upper body exercises and then reassembled to conduct the supine position exercises, and vice versa.

Similarly, as with the extension strap 22, the central hold 13 may include measure markings to measure how tightly the central hold is pulled through an adjuster so as to accommodate the span of the arms of different sized users. In an embodiment, the measured marks may be in half-inch increments for example. As a user increases in flexibility through the shoulders, the length of the central hold may be shortened gradually, either during a session of stretching exercises or in general.

Figure 12A:
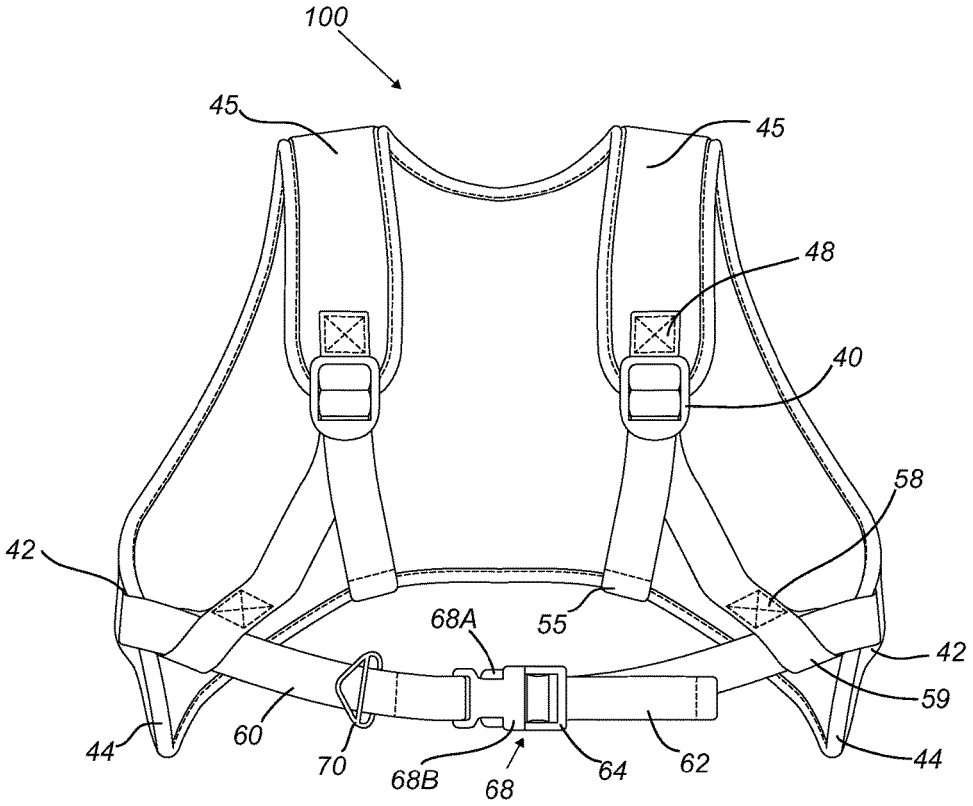
FIG. 12A and FIG. 12B illustrate the front view and rear view of the device vest portion, according to embodiments of the present invention.
Figure 12B:
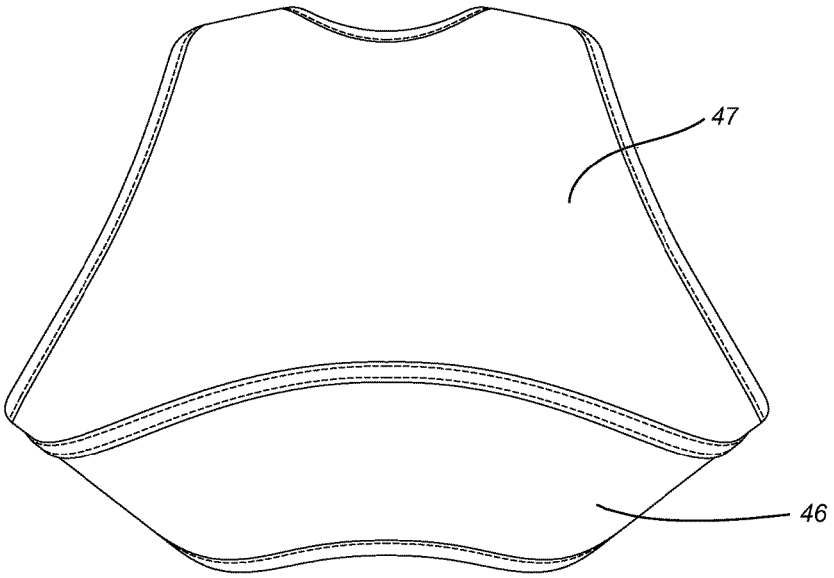

According to further embodiments, as illustrated in FIG. 12A-FIG. 12B, the device comprises a body harness in the form of a vest 100. FIG. 12A shows a front view of the vest 100 having strap length adjusters 40 located on the integral shoulder holds 45. These length adjusters 40 further server as tension locks as pressure is applied to the vest during the stretching motion. The length adjusters 40 according to an embodiment are located at each end 48 of the integral shoulder holds 45 of the vest and connected to each end 48 by a non-elastic flexible webbing material. According to embodiments of the present invention, the strap components are comprised of woven fabric such as cotton or synthetic material webbing such as a nylon sublimated webbing. Connected through each length adjuster 40 on the shoulder holds 45 is a shoulder strap 50 which extends downward form the shoulder holds 45 and connect to the central hold 60. The central hold/strap 60 is adjustable in length and transversely positioned across the chest or torso. The shoulder straps 50 may be connected to the central hold 60 as a loop 59 sewn over at each end 58, allowing for the central hold 60 to slide through the shoulder strap loops 59 and allowing the shoulder straps 50 to be adjusted toward the sides of the torso depending on the user's comfort. The shoulder straps 50 are also comprised of the non-elastic flexible strap material.

The movable segment 70 is provided to move independently along the central hold 60. In an embodiment, the movable segment 70 is provided as a triangular nylon capture piece as shown. The central hold/central strap 60 is formed of non-elastic flexible material is further positioned to go around the torso portion of the vest through a sleeve pocket opening 42 at each torso side 44 of the vest. The central strap 60 further comprising an insertion end 62 at which a connector assembly insertion piece 68A is located along with a strap adjuster 64. The insertion piece 68A is engaged with a receiving piece 68B attached to a receiving end 66 of the central strap 60. In an embodiment, the insertion piece 68A and receiving piece 68B form a buckle connection 68 connection assembly. The vest sleeve pocket is hollow (i.e. forms a sleeve 46) to receive the central strap around the torso in a hidden manner such that the central hold is only visible when emerged from the sleeve pocket openings 42 of the vest. The central strap 60 may therefore be pulled freely through the sleeve 46. FIG. 12B illustrates the rear view of the vest where the central hold is hidden in the sleeve pocket 46 which runs around the vest. The central hold may be slid through the sleeve pocket unencumbered such that when the two ends of the central hold are engaged, the central hold may be rotated such that the connector assembly 68 may be positioned to one side 44 of the torso near a sleeve pocket opening 42 or entirely hidden inside the sleeve pocket. This allows the movable segment to slide unobstructed in the front of the vest, for example between the points where the shoulder straps are connected to the central hold.

As shown in FIGS. 12A and 12B, according to an embodiment of the present invention, the vest is structured to be comfortably and effectively weight bearing for users of various sizes including different heights and weights. The vest is configured with a supportive back panel 47 continuing into wide shoulder holds and torso sections. The torso sections wrap to the sides of the torso and as noted, includes a pocket sleeve which continues around the back of the vest ending at an opening 42 on each side 44 of the torso. The vest is made of comfortable, breathable or moisture wicking materials or fabrics commonly used in sportswear, activewear or performance wear. The vest material may be padded for added comfort. The structure of the vest provides an even distribution of weight when in use and avoids uncomfortable pressure and pinching against the body, thereby further assisting with proper alignment of the body during use. The device therefore provides a form of spinal therapy in addition to the benefits in improving flexibility and range of motion in users.

Figures 13A, 13B, 14A, 14B, 15:
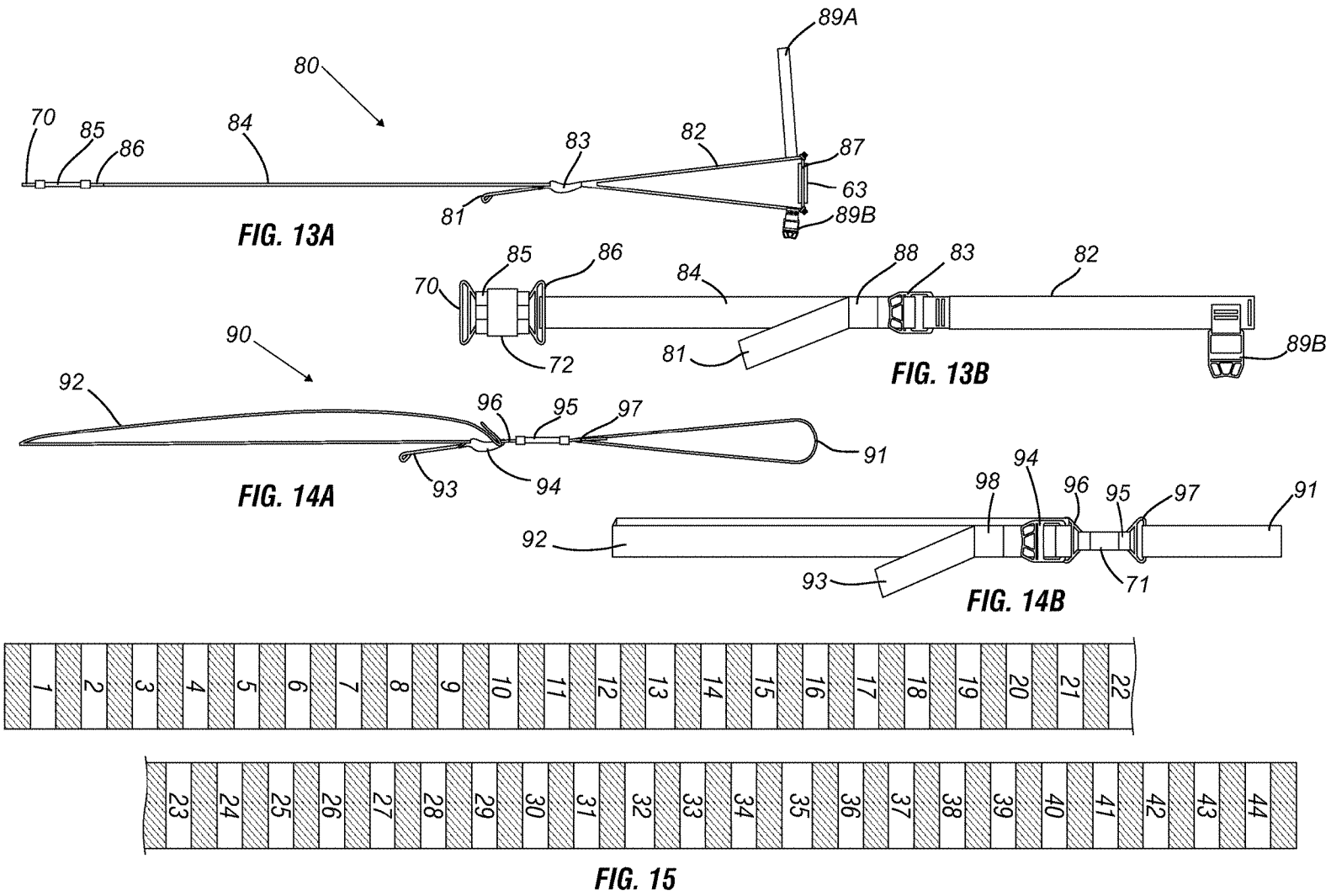
FIG. 13A illustrates a side view of the extension strap with an elastomeric segment attached to the extension strap, according to an embodiment of the present invention.
FIG. 13B illustrates an enlarged bottom view of the extension strap of FIG. 13A, according to an embodiment of the present invention.
FIG. 14A illustrates a side view of the device as a single strap provided with an elastomeric segment, according to an embodiment of the present invention.
FIG. 14B illustrates a bottom view of the device of FIG. 14A, according to an embodiment of the present invention.
FIG. 15 illustrates incremental numbered markings provided on a strap used in the device, according to an embodiment of the present invention.

FIG. 13A shows a side view of an extension strap 80 connected to the movable segment 70 of the body harness/vest. The extension strap 80 is segmented into a distal section 82 forming a support loop, for example a foothold; a tension lock/strap adjuster 83 which connects the looped support 82 to an adjustable portion 84 of the extension strap; and an elastomeric segment 85 positioned between the adjustable portion 84 of the extension strap and the movable segment 70 of the central hold 60. The elastomeric segment 85 is securely attached to the extension strap 84 by a connector 86, for example, by way of a thermoplastic connector, for example nylon glass-filled capture piece as shown, similar to the movable segment 70 material. In another embodiment, the foothold loop 82 comprises a gripped section 63 at the base 87 of the foothold 82 to engage the bottom of the user's foot/shoe. This gripped section 63 of the base 87 is shown at the most distal end of the foothold loop 82 as a straight section as an example. The grip section 63 may be comprised of a tube section and formed with a foam or cushioned overlay. This facilitates additional ease and comfort in catching the foot and keeps the loop in an open position ready to receive the foot. In another embodiment, the base 87 of the foothold may be enforced and horizontally long enough to support the width of two feet side by side in the foothold loop. For example, the base may comprise a ten-inch bar. This trapeze design shape of the foothold facilitates the proper distribution of weight and provides stability for the user as the device is fully self-contained and hands free. The device is configured for hands free movement thereby allowing the hands and arms to rest or be positioned freely. The grip at the base of the foothold loop further allows a user to position the edge of foot without slipping to fully extend and help stretch the Achilles tendon and do calf stretching. FIG. 13B shows a bottom view of the extension strap 80 of FIG. 13A. As shown, the extension strap end 81 is pulled through a strap adjuster 83. The extension strap 80 includes visual incremental markings, to show progress of flexibility. In an embodiment, the incremental markings are located on either side surface or both side surfaces of the adjustable portion 84 of the strap. In an embodiment, the entire length of the adjustable portion 84 includes the incremental markings to accommodate users of various sizes and flexibility. In an embodiment, the extension strap end portion 81 may be tucked in place by way of an adjustable thin stretchy sleeve 88 (shown in FIG. 13B). This sleeve 88 keeps the end portion 81 that is pulled through the strap adjuster 83 from falling in the way during use. In further embodiments, the foothold base 87 of the extension strap includes an adjustable foot strap having a foot strap 89A extending from one side of the foothold loop 82 and a strap adjuster 89B attached to an opposing side of the foothold loop. The foot strap 89A may be wrapped behind the heel of the user and the end of the foot strap pulled through the strap adjuster 89B. As shown in FIG. 13B, the strap adjuster 89B is shown in an enlarged view, with the foot strap 89A hidden in this view behind the foothold 82. The strap adjuster 83 essentially separates the adjustable portion 84 from the foothold loop 82 of the adjustable strap 80. In an embodiment, the strap adjuster 83 or a point after the strap adjuster toward the foothold loop 82, may be part of a connection assembly such that the foothold loop 82 may be removably connected to the adjustable portion 84 by a connection assembly, for example a buckle connection. In an embodiment, the length of the foothold loop is non-adjustable as the adjustability in length is determined with the adjustable portion 84. The size of the foothold loop is large enough to accommodate insertion of one or two feet of any size.

FIGS. 14A-14B illustrate the device according to a related embodiment of the present invention comprising an adjustable core band strap 90. The core band strap 90 may function as an arm strap and comprises a loop at a first end 91, attached through an elastomeric segment 95, to an adjustable loop at a second end 92. The strap provided with incremental markings on the adjustable length of the strap of the second end 92. In an embodiment, the entire length of the adjustable loop at the second end 92 includes the incremental markings to accommodate users of various sizes and flexibility. The strap, may be used for shoulder and arm stretching, is provided with an elastomeric segment 95 to create comfortable tension and an adjustable loop at one end to measure progress in stretching. One embodiment of the present invention is use of flexible but non-elastic material to create comfortable tension. According to embodiments of the present invention, the strap components are comprised of woven fabric such as cotton or synthetic material webbing such as a nylon sublimated webbing. In an alternative aspect, the single strap is provided with adjustable loops at both the ends. FIG. 14B shows the adjustable side 92 of the strap having an adjustable end 93 pulled through a strap adjuster 94. The strap adjuster 94 is connected to the elastomeric segment 95 by a secure capture piece 96. In an embodiment, the strap adjuster 94 is integral with a capture piece for connecting to the elastomeric segment 95. The elastomeric segment 95 is further attached to the opposing looped end 91 by another capture piece 97. In an embodiment, the adjustable end 93 may be tucked in place by way of an adjustable thin stretchy sleeve 98. This sleeve 98 keeps the end portion 93 that is pulled through the strap adjuster 94 out of the way during use. The strap adjuster 94 essentially separates the adjustable side 92 from the opposing looped end 91 of the core band strap 90. In an embodiment, the strap adjuster 94 or the start of the looped end 91, may be part of a connection assembly such that the looped end 91 may be removably connected to the adjustable side 92 by a connection assembly, for example a buckle connection. In an embodiment, the length of the looped end 91 is non-adjustable as the adjustability in length is determined with the adjustable side 92.

As discussed above, in embodiments of the present invention, the adjustable straps 84, 92 are provided with incremental markings to measure the length of the strap as it is pulled or loosened to accommodate the length of the arms or to increase flexibility. FIG. 15 shows an embodiment of the incremental markings located on one or more surfaces of a strap. In manufacturing the strap, the marking style applied may vary, and the number of markings may be increased or decreased depending on the length of the strap used. In this embodiment, the incremental markings span a length of 44 inches. For example, the beginning of the numbered markings on the strap 84, 92 is connected to the elastomeric segment connector 86, 96 and the markings increase toward the adjustable end 81, 93 which is pulled through the strap adjuster 83, 94. In an embodiment, the portion of the strap marked may be indicated at a base thirty inches and then shortened as flexibility improves or depending on height of the user. A user can improve and track flexibility with the measurement markings. As a user's flexibility increases, the increase of strap length pulled through the adjuster will indicate progress. The markings can further be an easily viewed indication such as prints, dye sublimation, silk screening, stencils, sewn markings or comprise of a rivet like attachment at which to set the strap length so that different users may interchangeably use the device and set the length quickly to the desired length. The markings can be located on the entire length of an adjustable strap or on portions of the strap. In other embodiments, the incremental markings may be identified by textured marks sensed by touch or marking which create an audible indication.

In another embodiment of the present invention, both the extension strap 80 and the core band strap 90 are attached to the body harness 100. The extension strap 80 may be attached to the central strap 60 via the movable segment 70, and the core band strap 90 also attached to the central strap 60 via a second movable segment (not shown) connected at the adjustable side 92 of the core band strap 90. Such second movable segment may be a similar capture piece as movable segment 70 which may easily slide along most of the length of the central strap 60 in front of the user's chest. The segment may also comprise one or more removable pieces. Alternatively, the adjustable side 92 of the core band strap may be connected to the body harness by directly looping the adjustable side 92 around the central strap 60. With both the extension strap 80 and core band strap 90 attached to the body harness/vest 100, the user may engage each strap with one leg to conduct simultaneous stretching of the legs. The user engages one foot in the foothold 82 of the extension strap 80 while engaging the other foot in the looped end 91 of the core band strap 90. Each strap 80 and 90 moving independently of one another. The separate straps allow for split leg stretching in various positions, including a sitting or supine position.

In embodiments of the present invention, as shown in FIGS. 17A-17F, the strap adjusters used throughout the device may be comprised in various forms. According to embodiment, the strap adjuster may take the form of a tap adjuster; or webbing loops, with a connector attached to the distal end, which can pass through the loop to connect to the strap of appropriate length for the user. In another embodiment, the strap adjustor is in the form of grommets in webbing with a handle attached to the distal end which can pass through the loop to connect to the strap of appropriate length for the user. In yet another embodiment, the strap adjustor is in the form of molded holes with a button and loop arrangement where the button attached to the distal end can pass through the molded holes to connect to the strap of appropriate length for the user. In yet another embodiment, the strap adjustor is in the form of rope or rubber adjustor or a rubber loop adjustor.

Figure 16A:
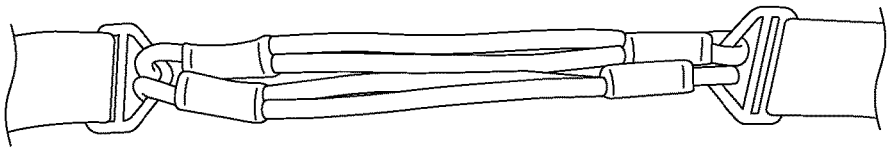
FIG. 16A and FIG. 16D illustrate the elastomeric section of a strap according to embodiments of the present invention.
Figure 16B:
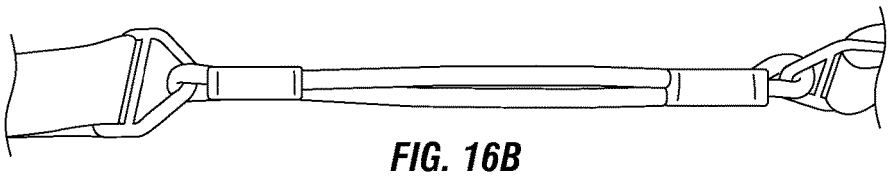
Figure 16C:
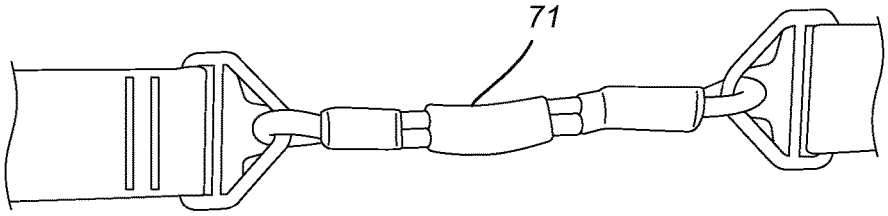
Figure 16D:
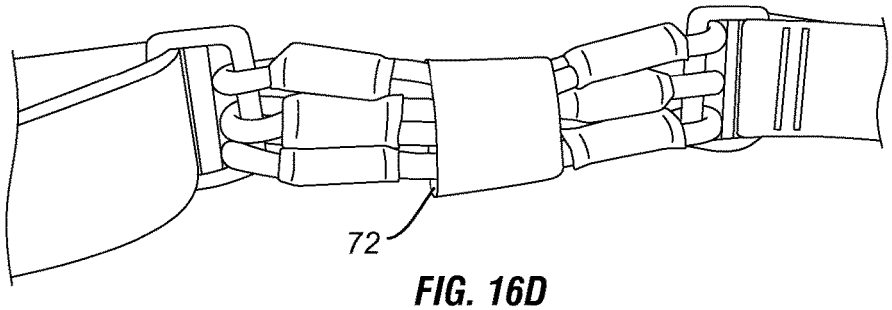
Figure 17A:
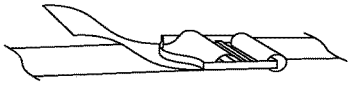
FIGS. 17A-FIG. 17F illustrate adjuster options for the straps according to embodiments of the present invention.
Figure 17B:
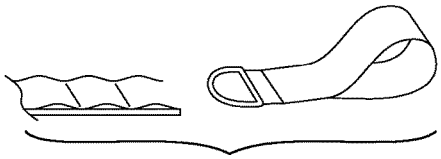
Figure 17C:
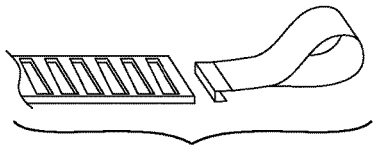
Figure 17D:
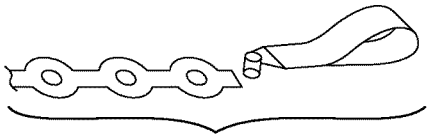
Figure 17E:
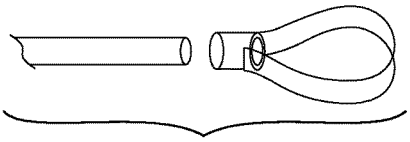
Figure 17F:
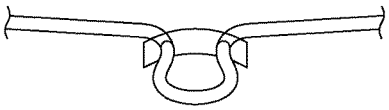
Figure 18A:
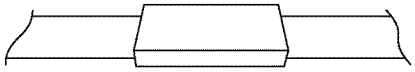
FIGS. 18A-FIG. 18F illustrate other elastomeric segment options for the strap, according to embodiments of the present invention.
Figure 18B:
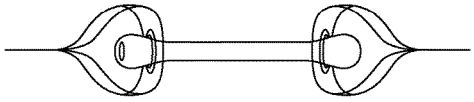
Figure 18C:
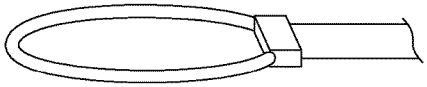
Figure 18D:
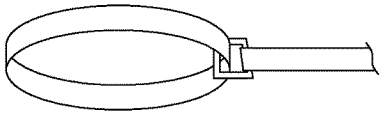
Figure 18E:
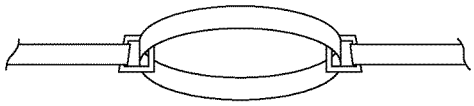
Figure 18F:
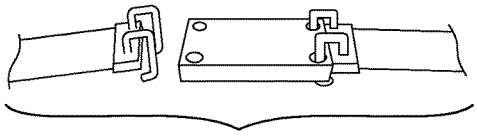

In embodiments of the present invention, the elastomeric segment 85, 95 comprises one or more elastomeric cords or tubes. In an embodiment, the elastomeric material is in the form of a plurality of bungee or shock cords as shown in FIG. 16A-16D. The cords may be contained by a flexible thin sleeve 71, 72. The elastomeric cords are connected at each end securely by capture pieces. As shown in FIG. 16A and FIG. 16B, a four cord and two cord elastomeric segment is illustrated. FIG. 16C further illustrates a two-cord embodiment of the elastomeric segment, contained by a removable flexible sleeve 71. Similarly, FIG. 16D further illustrates a six-cord embodiment of the elastomeric segment, contained by a removable flexible sleeve 72.

In other embodiments, as shown in FIGS. 18A-18F, the elastomeric segment can be a rubber segment formed as an in-molded rubber block. In another embodiment, the elastomeric segment is in the form of extruded rubber trapped in grommets. In other embodiments, extruded rubber may be trapped to form a handle; the elastomeric segment may form a rubber band trapped at one or both ends by rings for connection to the strap; an elastomeric segment connected by a hook connection to the straps. The elastic material may be comprised of elastomers or other elastic polymers. The elastomeric segment is precisely a minor portion of the overall length of the non-elastic extension strap or non-elastic core band strap. The length of the elastomeric segment 85 in the extension strap 80 is less than the length of at least one of the non-elastic strap sections/ends 82, 84. Similarly the length of the elastomeric segment 95 in the core band strap 90 is less than the length of at least one of the non-elastic looped ends 91, 92. In an embodiment the length of the elastomeric segment 85, 95 is less than both non-elastic strap portions in each of the extension strap 80 and the core band strap 90. The elastomeric segment is a discrete (separate and distinct) component of the device, comprising a different material of elasticity that the non-elastic strap material of the device. In further embodiments, depending on the type of attachment of the elastomeric segment, the elastomeric segment may be removably attached, replaceable and interchangeable with other types of elastomeric segments or be interchangeable so as to increase or decrease the amount of elasticity of the segment. The elastomeric segment has a strength of supporting at least 600 pounds and at least a force of 100 pounds.

Figure 19:
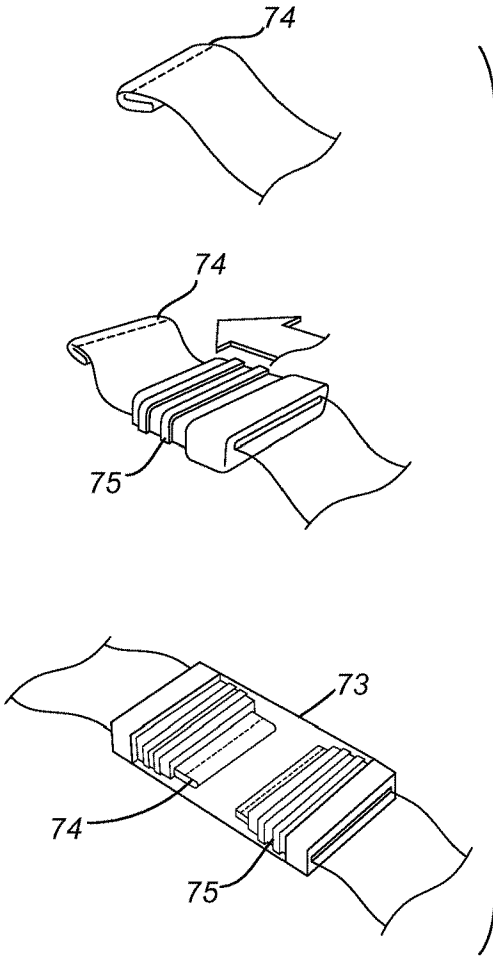
FIG. 19 illustrates an elastomeric segment of the strap and its construction, according to another embodiment of the present invention.
Figure 20:
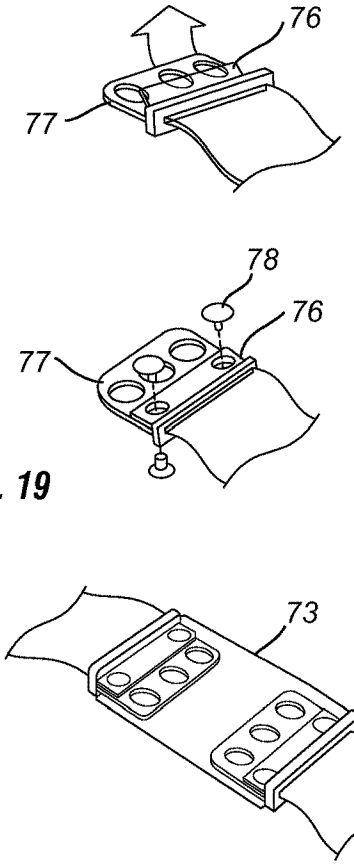
FIG. 20 illustrates an elastomeric segment of the strap and its construction, according to another embodiment of the present invention.
Figure 21:
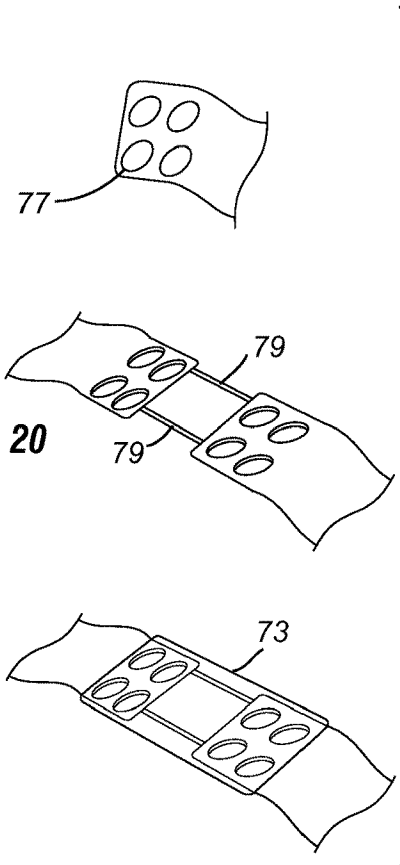
FIG. 21 illustrates an elastomeric segment of the strap and its construction, according to another embodiment of the present invention.

As shown in FIGS. 19-21, further embodiments of the elastomeric segment connection and construction are further illustrated in which the elastomeric segment 73 is formed by injection molding over two strap ends. Each view of the block 73 is a transparent view showing the two ends of the straps inside the injection molded elastomer. FIG. 19 illustrates an embodiment of the elastomeric segment as a co-molded rubber block 73 with a teethed section 75 attached to the strap ends for the rubber to catch on. The webbing strap end 74 is folded over and stitched, a toothed bead section 75 is slid onto the strap end the segment is injection molded with elastomer. FIG. 20 illustrates an embodiment of the elastomeric segment in which a plastic catch 76 is attached to each of the strap ends 77 (for example shown with circular heat cut ends of webbing strap) and the elastomeric segment formed by injection molding rubber 73 over the plastic catches 76. As shown, rivets 78 may be used to further secure the webbing material of the strap to the plastic catch parts 76 beneath the molded rubber. In yet another embodiment as shown in FIG. 21, the elastomeric segment can be a molded rubber block 73 over a heat cut webbing strap 77 held in place with weak threads 79 during molding. The weak threads 79 only serve the purpose of manufacturing the elastomeric segment by keeping the straps aligned. The weak threads are then broken by applying a certain amount of pressure when ready for use.

The versatility of the device is supported by the quick release mechanisms and adjustability of the straps. The device is useful in a variety of stretching, muscle strengthening and range of motion exercises, in a lightweight, sturdy, convenient and comfortable manner. The incremental markings on each of the adjustable portions of the straps provides for improved measurability of a user's progress which can be tracked quantitatively. The incremental progress/results can further be used as input in computerized tracking/monitoring or other fitness assessment applications.

The device as described with respect to FIGS. 12A-12B, 13A-13B may be used in a method for hands free stretching and increasing range of motion as described above as noted in FIGS. 3-5. The moveable segment 70 of the extension strap 80 is attached to a central strap 60 shown on FIG. 12A. The moveable segment 70 of FIG. 12A is simply shown disconnected from the extension strap 80 of FIGS. 13A and 13B. The extension strap is adjustable to a desired length for stretching using the plurality of incremental marks to identify the desired length; and tension is applied against the looped support 82 to perform self-contained hands-free stretching, the extension strap being movable relative to the movable guide segment 70 along the length of the central strap 60 in a transverse direction. The leg may be rotated similarly side-to-side in the transverse direction. The device 90 as described with respect to FIGS. 14A-14B may be used in a method for increasing range of motion and flexibility as described above in the exercises as noted in FIGS. 6-11. The method of using the device is fully self-contained and involves adjusting the adjustable end portion 92 of the strap to a desired length by using the plurality of incremental markings.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments of the foregoing description.

What is claimed is:

1. An exercise device comprising:

a body harness including a shoulder support strap and an adjustable length central strap adjustably coupled to the shoulder support strap, the central strap configured to surround at least a portion of an upper torso of a user;

a movable segment attached to and slidable along a length of the central strap; and a adjustable length extension strap comprising a first elastomeric portion and a second non-elastomeric portion, the extension strap being removably coupled to the movable segment, wherein the non-elastomeric portion includes a loop, wherein the elastomeric portion comprises a movable guide that is configured to adjust the length of the elastomeric portion, and wherein the extension strap is movable relative to the movable segment along the length of the central strap.

2. The device of claim 1, wherein the adjustment of the length of the elastomeric portion changes the length between the loop and the central strap.

3. The device of claim 1, wherein the adjustment of the length of the elastomeric portion changes the tension experienced by the user.

4. The device of claim 1, wherein the elastomeric portion is a plurality of elastomeric segments.

5. The device of claim 1, wherein the body harness includes a vest portion.

6. The device of claim 1, wherein the movable segment is coupled to the central strap by a ring or a buckle.

7. The device of claim 1, wherein movable segment includes a plurality of indicators.

8. The device of claim 1, wherein adjustable length extension strap includes a plurality of indicators.

9. The device of claim 1, wherein the elastomeric portion is removably attached to the adjustable length extension strap.

10. The device of claim 9, wherein the elastomeric portion is replaceable with a second elastomeric segment of different elasticity to create a different amount of tension.

* * * * *